US005913707A

United States Patent [19]

Roman et al.

[11] Patent Number: 5,913,707

[45] Date of Patent: Jun. 22, 1999

[54] DEVICES HAVING MAGNETICALLY LEVITATING COMPONENT

[75] Inventors: Rosa Linda Roman, Winter Haven; Joe Gawler, Miami, both of Fla.

[73] Assignee: Myriad Enterprises, Winter Haven, Fla.

[21] Appl. No.: 08/805,815

[22] Filed: Feb. 26, 1997

[51] Int. Cl.[6] ..... A63H 33/26

[52] U.S. Cl. ..... 446/131; 446/133; 428/16; 428/900

[58] Field of Search ..... 428/66.6, 16, 900; 446/131, 132, 129, 133, 489; 40/426

[56] References Cited

U.S. PATENT DOCUMENTS 3,550,936 12/1970 Puttick ..... 446/129
4,233,777 11/1980 Inoue ..... 446/131
5,188,555 2/1993 Zbegner ..... 446/129

OTHER PUBLICATIONS

H. Fishlove & Co. publication, "Out of this World", Mar. 1965.

*Primary Examiner*—Alexander Thomas
*Attorney, Agent, or Firm*—Saliwanchik, Lloyd & Saliwanchik

[57] ABSTRACT

The subject invention concerns an article of manufacture, which can be in various shapes and forms as disclosed herein, based on the principle of magnetic levitation. When motion is applied to the article of manufacture, there results a body moving through the air without mechanical support. This invention can be used for many purposes including entertainment and educational uses.

6 Claims, 1 Drawing Sheet

DEVICES HAVING MAGNETICALLY LEVITATING COMPONENT

BACKGROUND OF THE INVENTION

Small, mass-produced items which entertain and/or amuse are often referred to as novelty items or novelty devices. Novelty devices find widespread interest amongst many segments of the population. Such items are often useful to entertain and educate children and adults. For example, toys, such as rattlers, are novelty items which can be used to entertain babies. There are many toys, such as yo-yo's, which entertain children and teach them various aspects of the physical sciences. Other novelty items are useful to entertain adults. Examples are electronic displays, video games, and battery-powered jewelry. All such articles fulfill particular needs of education, entertainment, and the like.

There remains a constant need in society for a continuous flow of new and innovative novelty devices. This need arises from a changing and mixing of various people and cultures having different and varied tastes when it comes to being entertained. Also, although some novelty items, such as yo-yo's, may be popular for long periods of time, the more common trend is for people to continuously look for new sources of entertainment and amusement. Also, there is a constant need for new educational tools which help to bridge the gap between the known and unknown in a way that is understandable to different age groups.

It is in this context, that the subject invention is useful, not only to entertain and amuse, but also, in certain situations, to educate.

BRIEF SUMMARY OF THE INVENTION

The subject invention concerns a useful and novel article of manufacture. More specifically, the subject invention concerns an article, which can be in various shapes and forms as disclosed hereinafter, having a unique component which functions on the principle of magnetic levitation.

In a specific embodiment, the novel article of the subject invention comprises an elongate component, such as a pencil, to which is movably associated an object which slides along an axial length of the elongate component wherein the position and motion of the moveable object with respect to the elongate component, is affected by repelling magnetic forces. The magnetic repelling forces create an appearance of levitation which is referred to herein as magnetic levitation. Thus, the articles of the subject invention have an object which moves relative to an elongate component and is suspended without mechanical support.

With reference to FIG. 1, a specific embodiment of the subject invention comprises an elongate component 1 to which is affixed a first magnet 2. A second magnet 3 is movably associated with the elongate component and is positioned such that its polarity is opposite to that of the first magnet 2. The second magnet 3 can move in opposition to the polarity of the first magnet 2 upon any motion placed on the elongate component 1 or the second magnet 3. Affixed to, or otherwise associated with, the second magnet 3 is an object 4 which can be, for example, an ornamental figure. In a specific embodiment as shown in FIG. 1, this object is the body of an alligator 4. Serving as a means for impeding the movement of the second magnet 3 and attached object 4, so that they do not escape the elongate component 1, is a stopping means 5. In the specific embodiment shown in FIG. 1, the stopping means is affixed to the end of a pencil (the elongate component) and is formed into the shape of the head of an alligator 5. Upon providing motion to the elongate component 1 or the second magnet 3 or the object 4, the object 4 slides along the axial length of the elongate component between the first magnet 2 and the stopping means 5. In the absence of an applied force, the object 4 appears to levitate because of the opposed polarities of the first magnet 2 and the second magnet 3.

The elongate component 1 in the above example can be a pencil. Thus, this novel pencil is useful to provide entertainment for University of Florida fans (Gators), or to educate children on the principle of magnetic repelling forces.

DETAILED DISCLOSURE OF THE INVENTION

Figure 1:
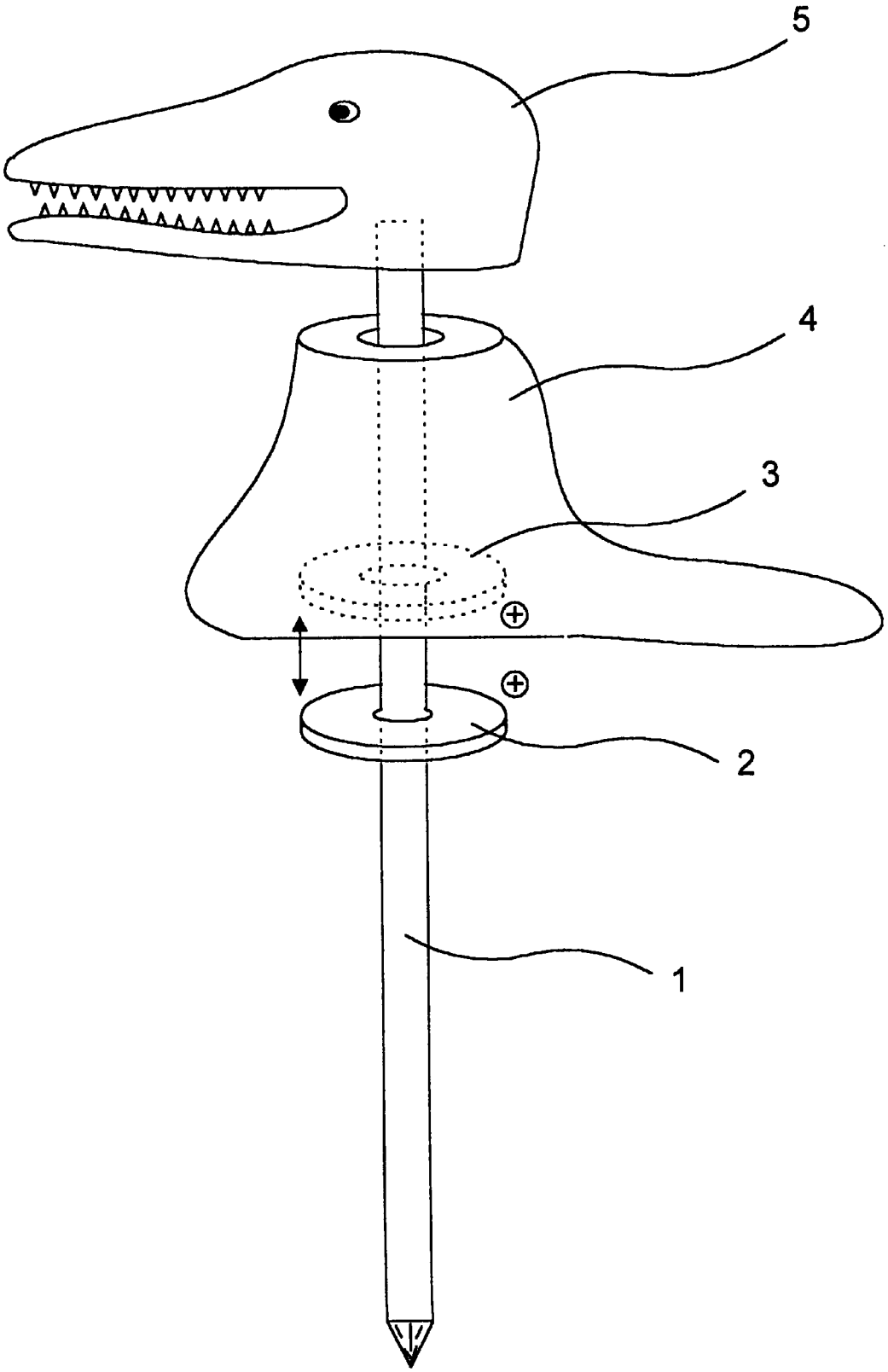
FIG. 1 shows a pencil adapted with a levitation means including an alligator which gives the illusion of moving through the air without support when motion is applied to the pencil.

The articles of the subject invention, using the principle of magnetic levitation, provide useful devices to both entertain and educate people of all ages.

In a specific embodiment, as shown in FIG. 1, the subject invention comprises (1) an elongate component 1 to which is affixed a first magnet 2; (2) a second magnet 3 is movably positioned about the axis of the elongate component 1 such that the magnetic polarity of the second magnet 3 opposes the magnetic polarity of the first magnet 2 which is attached to the elongate component 1; (3) an object 4, which can be ornamental, or a figurine depicting an animal or other object, is affixed to the second magnet 3; and, (4) a stopping means 5 is affixed to the elongate component 1 so that it is on the side of magnet 3 which is opposite to the side of magnet 3 facing magnet 2.

Upon applying a motion to the elongate component 1, or to the movable magnet 3 (or the object 4 associated with the second magnet 3), there results a movement of object 4 (and the magnet 3) along the axis of the elongate component 1. The movement of the second magnet 3 and the attached object 4 is constrained at one end of the axis of the elongate component by the first magnet 2 and at the other end by the stopping means S. The constraint imposed by the first magnet 2 is both a direct physical constraint due to the presence of the magnet physically blocking the movement of the object 4, as well as a magnetic effect caused by the magnetic field of the first magnet 2 repelling the magnetic field of the second magnet 3. The repelling effect of the two magnets is such that, when the elongate component 1 is in a vertical orientation, the second magnet 3, and the associated object 4, appear to float, or levitate, above the base magnet 2. This floating effect is caused by the offsetting of the gravitational pull on the object 4 and the repelling effect of the two magnets 2, 3.

The object 4 may be attached to the movable magnet 3. This attachment may be such that the magnet 3 is not visible as would be the case, for example, if the magnet 3 is contained within the object 4 or if the magnet 3 is embedded within the object 4.

If the object 4 is pushed down towards the first magnet 2, then released, it will spring upwards due to the repelling magnetic fields. If no further force is applied, the object 4 will come to a stationary position after some bouncing up and down on the axis of the elongate component. The motion which can be applied to the first body or movable magnet can be by any means known to man. For example, the motion can be by mechanical means. The object 4 cannot leave the axis of the elongate component because the elongate component passes through the object 4 and/or the second magnet 3, and because the stopping means 5 prevents the object 4 from coming off the end of the elongate component 1. When no movement is applied to any part of the article of the subject invention, the object 4 remains magnetically levitated above the first magnet 2.

Although FIG. 1 provides a specific embodiment of the subject invention, other embodiments fall within the scope of the subject invention. For example, magnet 2 can be moveable with its movement constrained in a manner which is analogous to magnet 3.

In an alternative embodiment of the subject invention, one or both magnets and any associated object(s) may be disposed within a containment system, such as a transparent cylinder, or other external tube, which allows the magnet(s) and associated object(s) to move freely but within the constraints of the cylinder such that the moveable magnet(s) cannot "flip" (to align in polarity with the other magnet), or escape from association with the elongate component. Thus, the magnets of the subject invention remain aligned as a result of a means for maintaining alignment. This means for maintaining alignment may be, for example, an elongate component or an external tube.

The object 4, of the above description, can be the body of an alligator with the stopping means 5 being the head of the alligator. The first body 1 in this example can be a pencil or pen.

Typically, the elongate component of the subject invention is forming an axis along which the object 4 can move. In a specific embodiment, the elongate component can be a pencil or a pen. Jewelry, such as ear rings and pins can also be prepared according to the subject invention. The cross section of the elongate component can be, for example, circular, square, rectangular, and the like. The elongate component may be portable, such as a pencil, or it can be stationary. For example, the device may be attached to an automobile dash board. Alternatively, it may stand on a desk, table, and the like. The mobility and position of the device largely depends on the intended use, e.g., entertainment or educational.

Magnets useable in the subject invention can be any magnets which, when brought together provide a repelling force from each other. The magnets can be structured to accommodate the particular objects used. The moveable magnet, i.e., the one which is not affixed to the elongate component, is positioned on the elongate component so that it can freely move along the axis of the elongate component under the effect of the repelling force of the magnet affixed to the elongate component. This moveable magnet, advantageously, should be structured to enable an object to be affixed to it in a manner not preventing movement of the magnet along the axis of the elongate component. For example, the magnets on a pencil as discussed above, can each be donut-shaped to fit around the pencil. The first magnet can be bonded to the pencil whereas the second magnet is free to move along the length of the pencil. This moveable magnet, in the example above, can have, for example, the body of an alligator bonded (affixed) to it so that the magnet can still move freely on the pencil.

As is readily apparent, there can be an infinite list of variations of the subject invention within the bounds of the subject disclosure and following claims.

The stopping means of the subject invention can be any immovable object which prevents the moveable magnet from escaping the elongate component. In the illustration of the pencil, given above, the stopping means can be the head of an alligator. The alligator head can be bonded to the top of the pencil. In another example, if the body bonded to the moveable magnet is that of a snake, then the stopping means can be the head of the snake, or, perhaps the head of another animal appearing to be ready to engulf the snake. Likewise, if the body of the animal bonded to the moveable magnet is a mouse, then the stopping means can be that of the head of a cat appearing to eat the mouse when motion is applied to the elongate component or to the movable magnet.

The physical arrangement of the magnets of the subject invention so that they repel within the constraints imposed by the elongate component and the stopping means is a critical aspect of the subject invention. Having arranged the magnets and the elongate component as described herein, a multitude of ornamental and entertaining designs can be made.

Either magnet 2, 3 and/or the object 4, and/or the stopping means can be colored, shaped, and/or decorated in any appropriate manner to achieve a desired entertaining, amusing, or educational result. The designs may be, for example, characters in parts (such as the alligator in FIG. 1); objects that are generally associated with each other (such as a baseball and glove); objects that engage/disengage; and objects which normally, or humorously, move up and down or back and forth.

A few of the multitude of possible designs include those listed in Table 1.

TABLE 1

| Object | Stopping Means |
|---|---|
| Baseball | Glove |
| Basketball | Basket |
| Mascot Body | Mascot Head |
| Cartoon Character Body | Cartoon Character Head |

The first magnet for these and other designs can be a floor, sports field, or other appropriate design.

In one embodiment of the subject invention, the elongate component comprises coiled wire to produce an electrical current when at least one of the magnets passes along the elongate component. The electrical current may then be used to produce another form of energy such as light, sound, or heat.

From the description of the subject invention, given above, it is clear to a person skilled in the art that the invention can be applied to an unlimited number of first bodies and objects depicting a variety of animals, figurines, ornamental objects, educational objects, and the like.

Although the design of the subject invention is exemplified with certain characters and with pens and pencils, it will be readily apparent to those having the benefit of the instant disclosure that other designs embodying the concept of the subject invention can be readily envisioned, produced, and used.

Following are examples which illustrate the invention. These examples should not be construed as limiting.

EXAMPLE 1

Pencil with Alligator

A standard pencil can be used. A first donut shaped magnet is bonded about two inches from the end of the pencil which is opposite the writing end. A second donut shaped magnet is slipped over the head of the pencil (the end opposite the writing end). To this second magnet is bonded a plastic (or other material) body of an alligator. On top of the head of the pencil is permanently bonded the head of an alligator.

Upon using the pencil to write, there appears the illusion of the body of the alligator moving, without structural support, along the aids of the pencil back and forth towards and away from the head of the alligator.

EXAMPLE 2

Pencil with Other Characters

Upon substituting the body of the alligator and head of the alligator, as described in Example 1, with the body and head of similar or different characters, there is obtained a pencil giving the illusion of movement of the character body when motion is applied to the pencil.

The subject invention includes articles of manufacture comprising a) a first magnet; b) a second magnet allowed to approach the first magnet until the first and second magnets magnetic fields interact to cause the first and second magnets to move apart; and c) a means of maintaining the alignment of the first and second magnets so that the first and second magnets continually or periodically repel each other.

It should be understood that the examples and embodiments described herein are for illustrative purposes only and that various modifications or changes in light thereof will be suggested to persons skilled in the art and are to be included within the spirit and preview of this disclosure and the scope of the appended claims.

We claim:

1. An article of manufacture comprising (a) an elongate component, wherein said elongate component is a pencil or a pen;

(b) a first magnet affixed to said elongate component;

(c) a second magnet positioned on said elongate component, said position being such that magnetic fields of said first magnet and said second magnet repel each other and wherein said second magnet can move freely along the axis of said elongate component;

(d) an object affixed to said second magnet, where said object and second magnet are positioned on said elongate component such that said object and second magnet can move freely on said elongate component when repelling forces are applied by said first magnet; and, (e) a stopping means affixed to said elongate component limiting the range of motion of said second magnet.

2. An article of manufacture comprising:

(a) an elongate component;

(b) a first magnet affixed to said elongate component;

(c) a second magnet positioned on said elongate component, said position being such that magnetic fields of said first magnet and said second magnet repel each other and wherein said second magnet can move freely along the axis of said elongate component;

(d) an object affixed to said second magnet, where said object and second magnet are positioned on said elongate component such that said object and second magnet can move freely on said elongate component when repelling forces are applied by said first magnet; and (e) a stopping means affixed to said elongate component limiting the range of motion of said second magnet, wherein said object affixed to said second magnet is the body of an alligator; and and wherein said stopping means is the head of an alligator.

3. An article of manufacture comprising (a) an elongate component;

(b) a donut shaped first magnet affixed to said elongate component;

(c) a donut shaped second magnet positioned on said elongate component, said position being such that magnetic fields of said first magnet and said second magnet repel each other and wherein said second magnet can move freely along the axis of said elongate component;

(d) the body of an alligator affixed to said second magnet, wherein the body of the alligator and second magnet are positioned on said elongate component such that said body of an alligator and second magnet can move freely on said elongate component when repelling forces are applied by said first magnet; and, (e) a stopping means affixed to said elongate component limiting the range of motion of said second magnet, wherein the stopping means has the appearance of the head of an alligator.

4. An article of manufacture comprising (a) an elongate component;

(b) a first magnet affixed to said elongate component;

(c) a second magnet positioned on said elongate component, said position being such that magnetic fields of said first magnet and said second magnet repel each other and wherein said second magnet can move freely alone the axis of said elongate component;

(d) an object affixed to said second magnet, where the object and second magnet are positioned on said elongate component such that said object and second magnet can move freely on said elongate component when repelling forces are applied by said first magnet;

(e) a stopping means affixed to said elongate component limiting the range of motion of said second magnet; and, (f) a wire coiled about said elongate component to produce an electrical current when one of said magnets passes along said elongate component.

5. The article of manufacture, according to claim 4, wherein said electrical current lights a light.

6. The article of manufacture, according to claim 4, wherein said electrical current produces a noise.

* * * * *

UNITED STATES PATENT AND TRADEMARK OFFICE

CERTIFICATE OF CORRECTION

PATENT NO. : 5,913,707

DATED : June 22, 1999

INVENTOR(S) : Rosa Linda Roman, Joe Gawler

It is certified that error appears in the above-identified patent and that said Letters Patent is hereby corrected as shown below:

Column 2, line 44: "means S." should read --means 5.--.

Column 5, line 9: "the aids of" should read --the axis of--.

Signed and Sealed this
First Day of February, 2000

*Attest:*

Q. TODD DICKINSON

*Attesting Officer*

*Acting Commissioner of Patents and Trademarks*